US006681597B1

(12) United States Patent
Yin et al.

(10) Patent No.: US 6,681,597 B1
(45) Date of Patent: Jan. 27, 2004

(54) INTEGRATED SUCTION LINE HEAT EXCHANGER AND ACCUMULATOR

(75) Inventors: Jian-Min Yin, Kenosha, WI (US); Stephen Memory, Kenosha, WI (US); Richard M. DeKeuster, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/287,388

(22) Filed: Nov. 4, 2002

(51) Int. Cl.[7] ..... F25B 43/00
(52) U.S. Cl. ..... 62/503; 62/513
(58) Field of Search ..... 62/503, 509, 513

(56) References Cited

U.S. PATENT DOCUMENTS

| | | | | | |
|---|---|---|---|---|---|
| 2,467,078 | A | | 4/1949 | Cahenzli, Jr. | |
| 2,530,648 | A | | 11/1950 | Cahenzli, Jr. | |
| 2,740,263 | A | * | 4/1956 | Kritzer | 62/218 |
| 2,819,592 | A | * | 1/1958 | Smith | 62/278 |
| 2,990,698 | A | | 7/1961 | Crotser | |
| 3,163,998 | A | | 1/1965 | Wile et al. | |
| 3,621,673 | A | * | 11/1971 | Foust | 62/503 |
| 3,765,192 | A | * | 10/1973 | Root | 62/324.6 |
| 3,955,375 | A | | 5/1976 | Schumacher | |
| 4,217,765 | A | * | 8/1980 | Ecker | 62/503 |
| 4,537,045 | A | * | 8/1985 | Mayer | 62/503 |
| 6,185,957 | B1 | * | 2/2001 | Voss et al. | 62/513 |
| 6,233,969 | B1 | | 5/2001 | Yamauchi et al. | |
| 6,298,687 | B1 | | 10/2001 | Dienhart et al. | |
| 6,460,358 | B1 | * | 10/2002 | Hebert | 62/225 |

* cited by examiner

*Primary Examiner*—William E. Tapolcai
(74) *Attorney, Agent, or Firm*—Wood, Phillips, Katz, Clark & Mortimer

(57) ABSTRACT

An integrated unit (10) in a refrigeration system (100) wherein a low-pressure conduit (18) and high-pressure conduit (36) are in conductive heat exchange relation to each other within an accumulator housing (12). The low pressure conduit (18) and high-pressure conduit (36) may be flat tubes wherein broad sides of the flat tubes are in conductive heat exchange relation to each other. The low-pressure conduit (18) and high-pressure conduit (36) or tubes have longitudinal axes (40, 42, respectively) that extend parallel to one another over a length (44) within the integrated unit (10).

16 Claims, 5 Drawing Sheets

INTEGRATED SUCTION LINE HEAT EXCHANGER AND ACCUMULATOR

FIELD OF THE INVENTION

This invention pertains to refrigeration systems that include a suction line heat exchanger and an accumulator. Particularly, the invention relates to integrated units having a suction line heat exchanger positioned within a reservoir of a suction line accumulator.

BACKGROUND OF THE INVENTION

Refrigeration systems for use in automobile cooling and home refrigeration applications are comprised of several components. Generally, such refrigeration systems contain a series of process units including compressors, condensers, evaporators, expansion devices, suction line heat exchangers, and liquid accumulators. In order to conserve space within the cooling and refrigeration systems, reduce costs and reduce the number of fittings required, and to make the systems more compact, several applications have integrated the suction line heat exchanger and liquid accumulator functions of these processes into one unit.

Two examples of an integrated heat exchange unit and accumulators are given in U.S. Pat. Nos. 2,467,078 and 2,530,648. In these patents, a coiled tube is wrapped around a straight tube for heat exchange between the two tubes within an accumulator. In another example, U.S. Pat. No. 3,163,998, heat exchange fins are closely associated with a tube that encircles a length of low pressure tubing that is withdrawing vapor from an accumulator to provide heat exchange advantages. In U.S. Pat. No. 6,298,687, concentric tubing is used within a collection unit. While at least some of these integrated units may perform satisfactorily for their intended purpose, there is always room for improvement.

SUMMARY OF THE INVENTION

In one embodiment, an integrated unit is provided for use in a refrigeration system having a refrigerant loop with a high-pressure refrigerant flowing through a portion of the loop to reject heat from the system and a low-pressure refrigerant flowing through another portion of the loop to absorb heat to the system. The integrated unit includes a housing having a collection reservoir for the refrigerant; a low pressure flat tube extending into the collection reservoir to direct the low pressure refrigerant therethrough; and a high pressure flat tube extending into the collection reservoir to direct the high pressure refrigerant therethrough. A broad side of the low pressure flat tube and a broad side of the high pressure flat tube are in close heat exchange relation to each other within the collection reservoir.

In another embodiment, an integrated unit in a refrigeration system includes a housing having a collection reservoir, a low pressure refrigerant inlet port, a low pressure refrigerant outlet port, a high pressure refrigerant inlet port and a high pressure refrigerant outlet port; a low pressure conduit connected in the housing to the low pressure refrigerant outlet port to direct low pressure refrigerant from the collection reservoir to the low pressure refrigerant outlet port; a high pressure conduit extending in the housing from the high pressure refrigerant inlet port to the high pressure refrigerant outlet port; and a plurality of heat exchange fins extending from the high pressure conduit and the low pressure conduit in the collection reservoir. Each fin is in close heat exchange relation with both the high pressure conduit and the low pressure conduit.

In a further embodiment of the integrated unit, the low-pressure conduit and the high-pressure conduit are flat tubes.

In a further embodiment, the low-pressure flat tube and the high-pressure flat tube are in close heat exchange relation to each other.

In yet a further embodiment, the low-pressure flat tube and the high-pressure flat tube have longitudinal axes extending parallel to each other.

In still a further embodiment, the plurality of heat exchange fins extend transversely from both the high-pressure conduit and low pressure conduit in the collection reservoir.

In another embodiment, the integrated unit further includes at least one slot in each fin that receives both tubes. In a further embodiment, each slot is open to an edge of the fin to allow assembly of the fins onto the tubes.

In another embodiment, the integrated unit comprises a housing having a collection reservoir, a low pressure refrigerant inlet port, a low pressure refrigerant outlet port, a high pressure refrigerant inlet port, a high pressure refrigerant outlet port; a low pressure conduit connected in the housing to the low pressure refrigerant outlet port to direct low pressure refrigerant from the collection reservoir to the low pressure refrigerant outlet port; a high pressure conduit extending in the housing from the high pressure refrigerant inlet port to the high pressure refrigerant outlet port; and at least one heat exchange fin extending between a first leg of the high-pressure conduit and a second leg of the high-pressure conduit in the collection reservoir and fin being in conductive heat exchange relation with the high-pressure conduit.

In another embodiment, an integrated unit in a refrigeration system includes a housing having a collection reservoir, a low pressure refrigerant inlet port, a low pressure refrigerant outlet port, a high pressure refrigerant inlet port and a high pressure refrigerant outlet port; a low pressure conduit with an outside surface and a longitudinal axis, the low pressure conduit extending in the collection reservoir and connected to the low pressure refrigerant outlet port to direct low pressure refrigerant from the collection reservoir to the low pressure refrigerant outlet port; and a high pressure conduit with an outside surface and a longitudinal axis, the high pressure conduit extending in the collection reservoir from the high pressure refrigerant inlet port to the high pressure refrigerant outlet port. In the collection reservoir the longitudinal axes extend parallel to one another over a length and the outside surfaces are in close heat exchange relation.

In a further embodiment, the outside surfaces are in direct contact with one another.

In yet a further embodiment, the integrated unit comprising a plurality of heat exchange fins extending transversely from the high pressure conduit and from the low pressure conduit, each fin in close heat exchange relation with both the high pressure conduit and the low pressure conduit.

Another embodiment of the invention is a refrigeration system including a compressor to compress a refrigerant; a heat exchanger to reject heat from the compressed refrigerant; an expansion device to expand the compressed refrigerant; an evaporator to transfer heat to the refrigerant; and an integrated suction line heat exchanger and accumulator. The integrated suction line heat exchanger and accumulator includes a collection reservoir; a low pressure flat tube extending into the collection reservoir to direct the expanded refrigerant therethrough; and a high pressure flat tube extending into the collection reservoir to direct the compressed refrigerant therethrough. A broad side of the low pressure flat tube and a broad side of the high pressure flat tube are in conductive heat exchange relation within the housing.

In another embodiment is a refrigeration system comprising a compressor to compress a refrigerant; a heat exchanger to reject heat from the compressed refrigerant; an expansion device to expand the compressed refrigerant; an evaporator to transfer heat to the refrigerant; and an integrated suction line heat exchanger and accumulator. The integrated suction line heat exchanger and accumulator includes a collection reservoir; a low pressure refrigerant inlet port; a low pressure refrigerant outlet port; a high pressure refrigerant inlet port and a high pressure refrigerant outlet port; a low pressure conduit connected in the housing to the low pressure refrigerant outlet port to direct the expanded refrigerant from the collection reservoir to the low pressure refrigerant outlet port; a high pressure conduit extending in the housing from the high pressure refrigerant inlet port to the high pressure refrigerant outlet port; and a plurality of heat exchange fins extending from the high pressure conduit and the low pressure conduits in the collection reservoir, each fin in conductive heat exchange relation with both the high pressure line and the low pressure line.

In yet another embodiment, a refrigeration system comprises a compressor to compress a refrigerant; a heat exchanger to reject heat from the compressed refrigerant; an expansion device to expand the compressed refrigerant; an evaporator to transfer heat to the refrigerant; and an integrated suction line heat exchanger and accumulator. The integrated suction line heat exchanger and accumulator includes a collection reservoir; a low pressure refrigerant inlet port, a low pressure refrigerant outlet port; a high pressure refrigerant inlet port; a high pressure refrigerant outlet port; a low pressure conduit with an outside surface and a longitudinal axis and connected in the collection reservoir to the low pressure refrigerant outlet port to direct the expanded refrigerant from the collection reservoir to the low pressure refrigerant outlet port; and a high pressure conduit with an outside surface and a longitudinal axis. The high pressure conduit extends in the collection reservoir from the high pressure refrigerant inlet port to the high pressure refrigerant outlet port. In the collection reservoir, the longitudinal axes extend parallel to one another over a length and the outside surfaces are in close heat exchange relation.

DETAILED DESCRIPTION OF THE INVENTION

Figure 1:
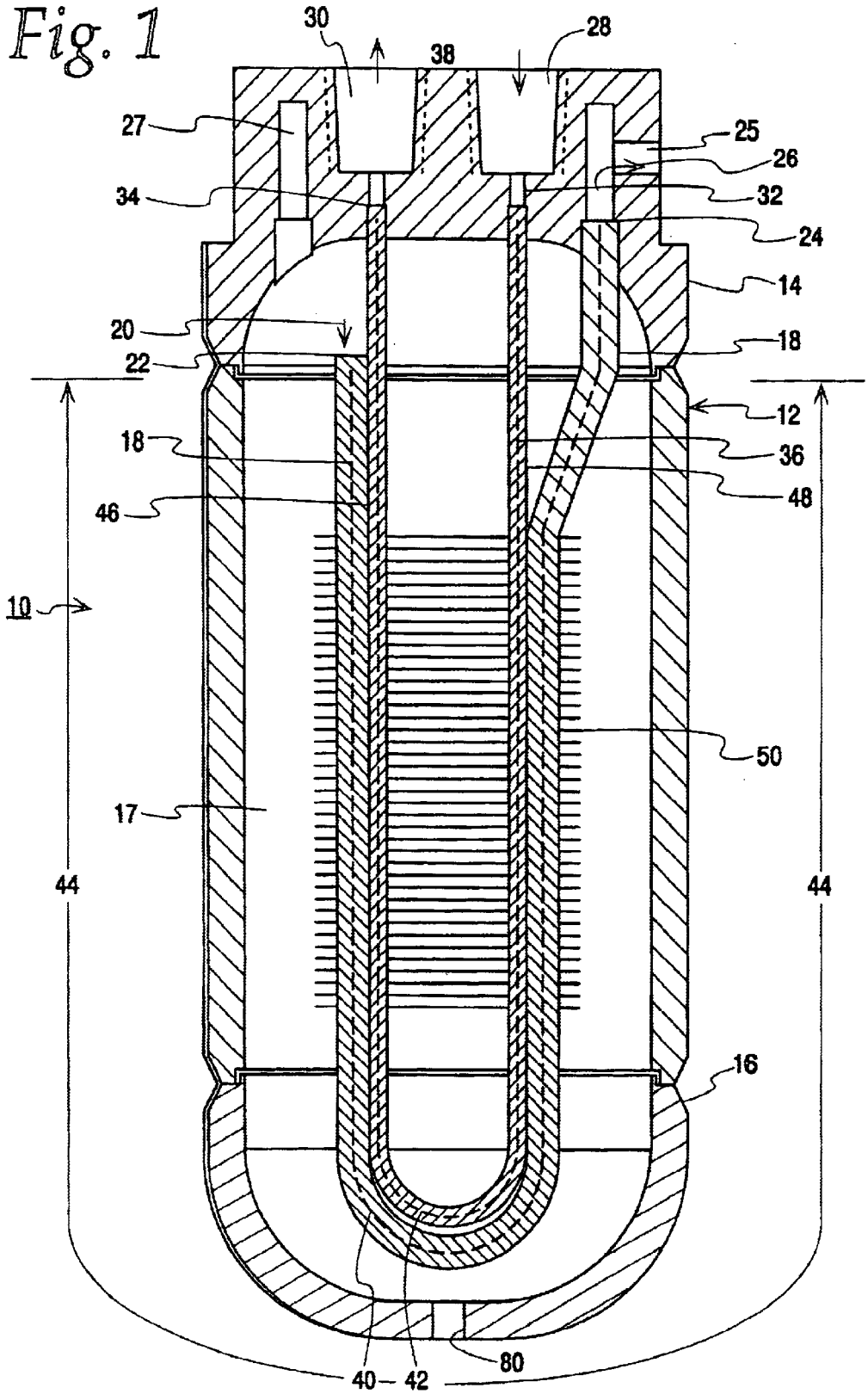
FIG. 1 is a cross-sectionial view of an embodiment of the integrated suction line heat exchanger and accumulator unit of the present invention.

An integrated suction line heat exchanger and accumulator unit 10 embodying the present invention is represented in FIG. 1. A housing 12 connects a cap 14 on one end and a reservoir cap 16 on the opposite end from the cap 14 to enclose a collection reservoir or chamber 17 within the unit 10 to receive low pressure refrigerant and separate the refrigerant into its liquid and vapor phases. A low-pressure conduit 18 directs the flow of a low-pressure refrigerant within the housing 12 in the direction of the arrow 20 through a low-pressure refrigerant inlet port 22 which in the illustrated embodiment is an open end of the tube. The low-pressure refrigerant enters the low-pressure refrigerant inlet port 22 in the direction depicted by the arrow 20 and flows through the low-pressure conduit 18 to a low-pressure refrigerant outlet port 24 which in the illustrated embodiment is an open end of the tube. The low-pressure refrigerant exits the integrated unit 10 through a port 25 in the cap 14 as indicated by the arrow 26. The cap 14 also contains a port 27 to direct low pressure refrigerant into the chamber 17.

The cap 14 contains two portals 28, 30 that fluidly connect a high pressure refrigerant inlet port 32 and a high pressure refrigerant outlet port 34 to other units of the refrigeration system in which the integrated unit 10 is used. In the illustrated embodiment, the ports 32, 34 are open ends of the high-pressure conduit 36 which loops through the housing 12. The high-pressure refrigerant flows through the high-pressure conduit 36 in the direction indicated by the arrow 38 from the high-pressure refrigerant inlet port 32 to the high pressure refrigerant outlet port 34. Preferably, the refrigerant within the low-pressure conduit 18 and high-pressure conduit 36 is in a countercurrent flow configuration.

The low-pressure conduit 18 and the high-pressure conduit 36 may be tubes with a circular cross-section, but are preferably flat tubes. Within the housing 12, both the low-pressure conduit 18 and the high-pressure conduit 36 have longitudinal axes 40, 42 respectively. The longitudinal axes 40, 42 extend parallel to one another, preferably over at least a majority of their lengths 44 within the housing 12. The low-pressure conduit 18 has an outside surface 46 and the high-pressure conduit 36 has an outside surface 48 with the surfaces 46 and 48 facing each other with a conductive heat path therebetween. It is preferable that the low-pressure conduit 18 and the high-pressure conduit 36 are in contact over the entire area or substantially the entire area of the surfaces 46, 48 over the length 44. However, is should be appreciated that direct contact may not be possible over the entire length 44, or that there may be another conductive path between the two conduits 18, 36. Furthermore, direct contact between the outside surfaces 46, 48 may not always be required for adequate heat exchange. For example, the surfaces 46, 48 may be placed close to one another with a heat conductive material sandwiched therebetween such that they are in conductive heat exchange relation.

Optionally, a plurality of heat exchange fins 50 may extend from the high pressure conduit 36 and the low pressure conduit 18, with each fin 50 being in a conductive heat exchange relation with both the low pressure conduit 18 and the high pressure conduit 36. Preferably, the fins 50 have slots 52 formed therein, with the slots 52 forming openings 54 that allow the fins 50 to slide onto the conduits 18, 36 with the conduits 18, 36 and the fins 50 assembled as a unit. Preferably, the sides of the slots 52 contact the corresponding sides of the conduits 18, 36 and are bonded thereto using a suitable bonding technique such as brazing or soldering.

Figure 2:
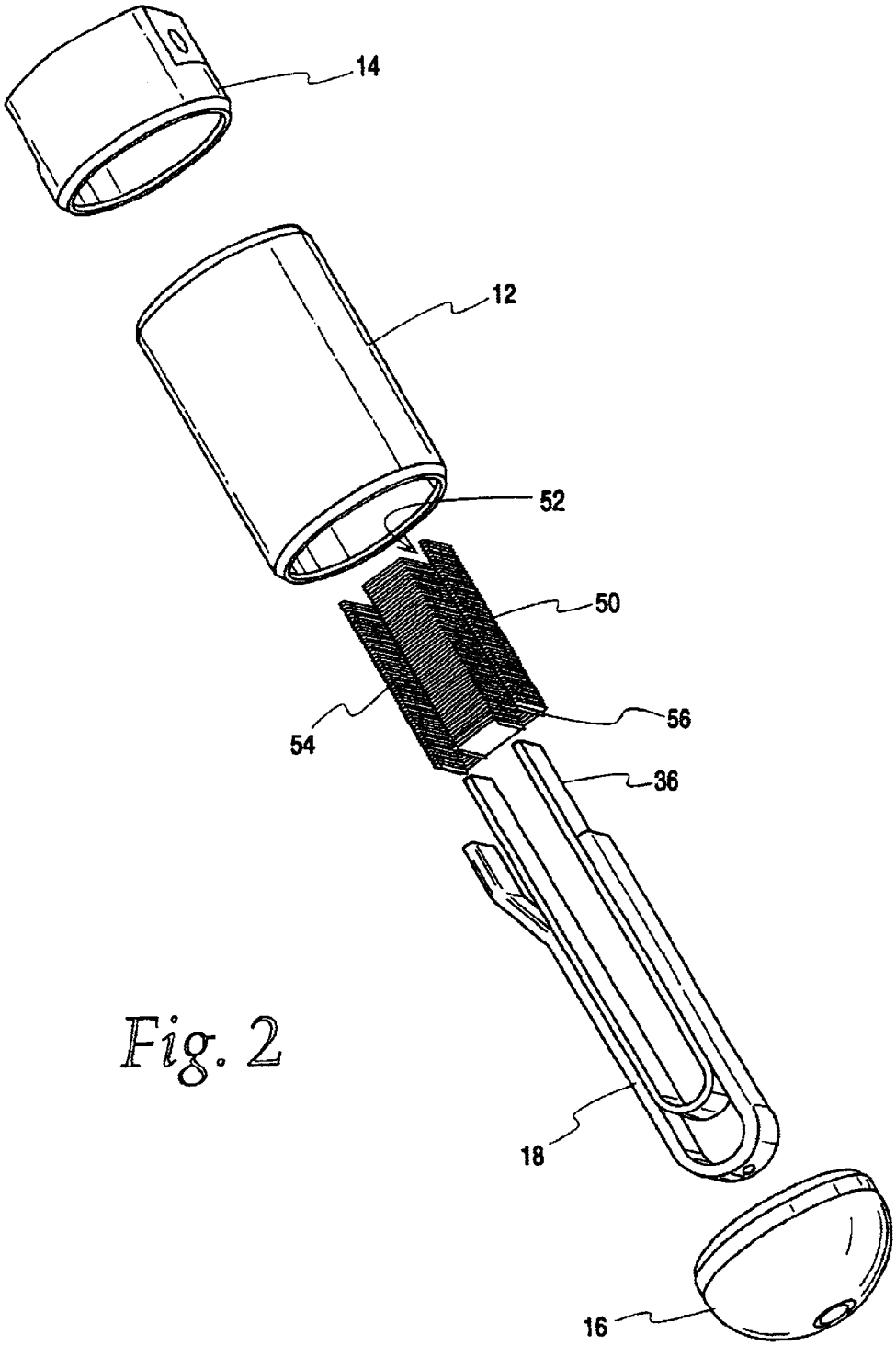
FIG. 2 is an exploded perspective view of the embodiment of the integrated unit depicted in FIG. 1.
Figure 3:
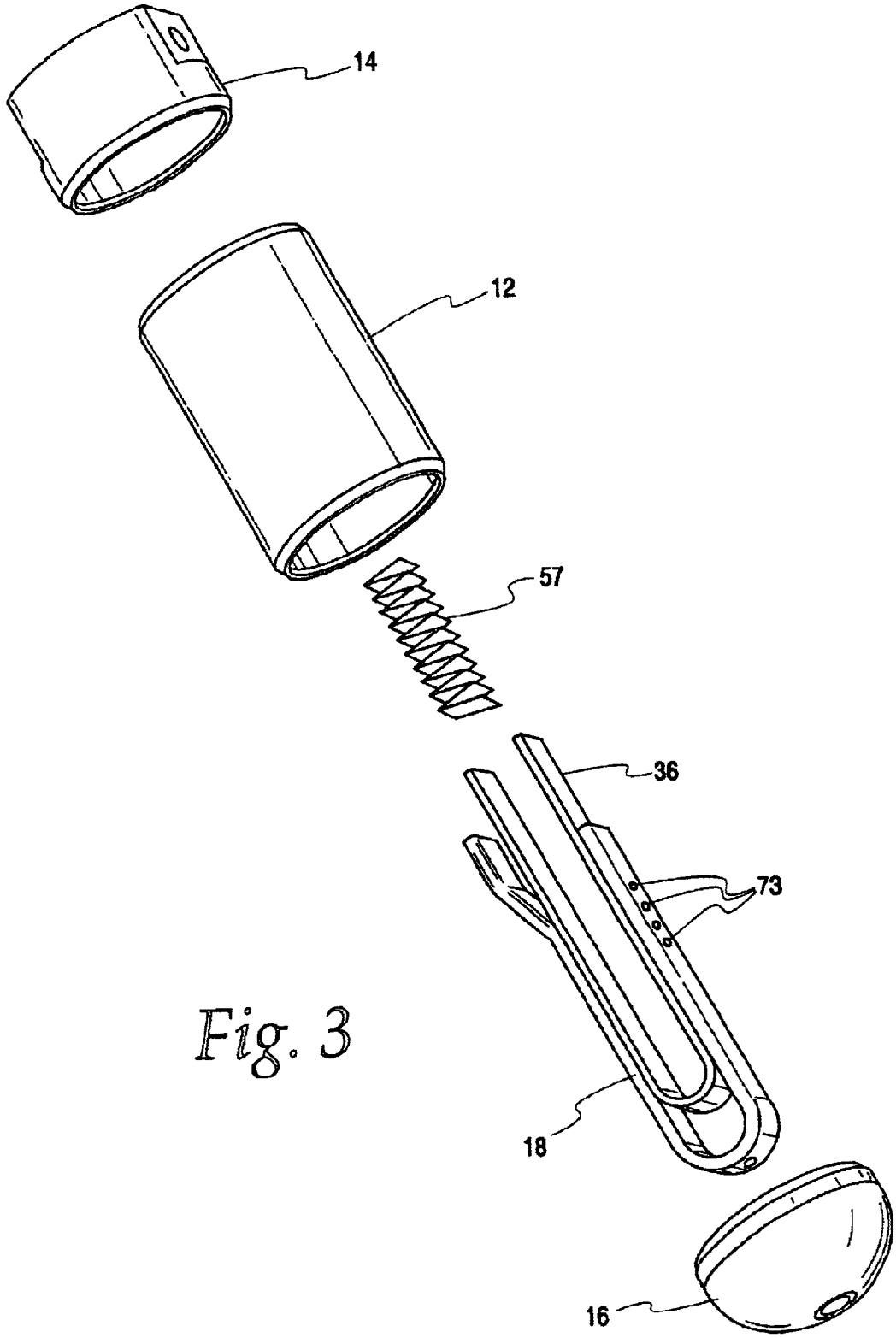
FIG. 3 is an exploded perspective view of another embodiment of the integrated unit of the present invention.
Figure 5:
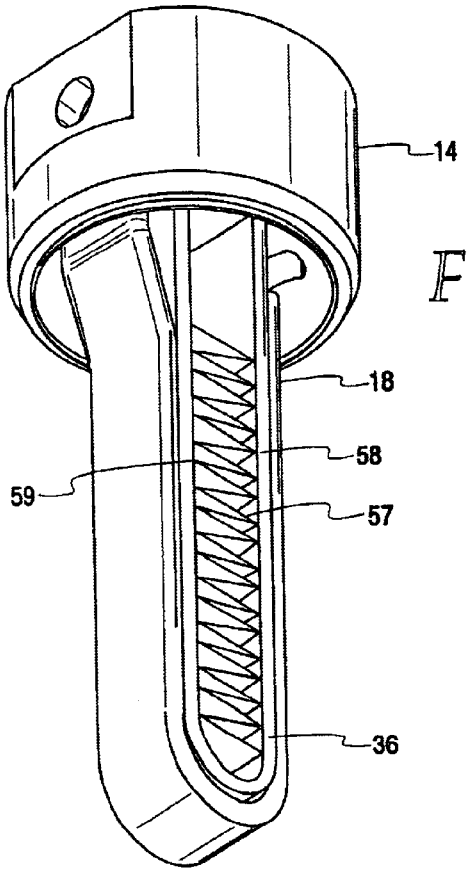
FIG. 5 is a perspective view of an embodiment of the integrated unit of the present invention with the housing of the accumulator removed.
Figure 4:
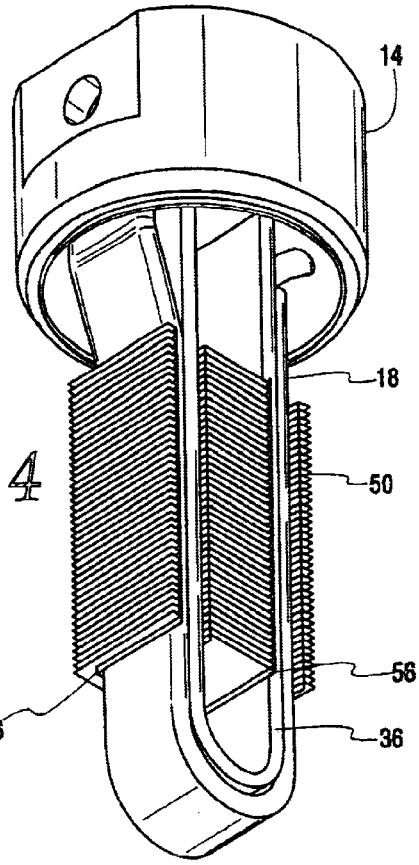
FIG. 4 is a perspective view of an embodiment of the integrated unit of the present invention with the housing of the accumulator removed.

The fins 50 also have flanges 56 to provide guidance of the unit of fins 50 onto the conduits 18, 36 and to further assist in the conduction of heat between the conduits 18, 36 and the fins 50. The integrated unit 10 can be constructed without the fins 50. However, when the fins 50 are included in the unit 10, the fins 50 assist in heat transfer from the high pressure refrigerant in the high-pressure conduit 36 to the low pressure refrigerant in the chamber 17. The fins 50 maybe, for example, the plate fins 50 depicted in FIGS. 1, 2 and 4 or maybe a serpentine fin 57 as depicted in FIGS. 3 and 5. The serpentine fin 57 is in conductive heat exchange relation with a first leg 58 and a second leg 59 of the high-pressure conduit 36. Preferably, the fin 57 contacts the legs 58, 59 and is bonded thereto using a suitable bonding technique, such as brazing. The serpentine fin 57 may be folded horizontally between the first leg 58 and the second leg 59 of the high-pressure conduit 36 as depicted in FIG. 5 or may be folded vertically (not shown). While one fin 57 is shown, there may be some applications where more than one fin 57 is desirable.

Figure 6:
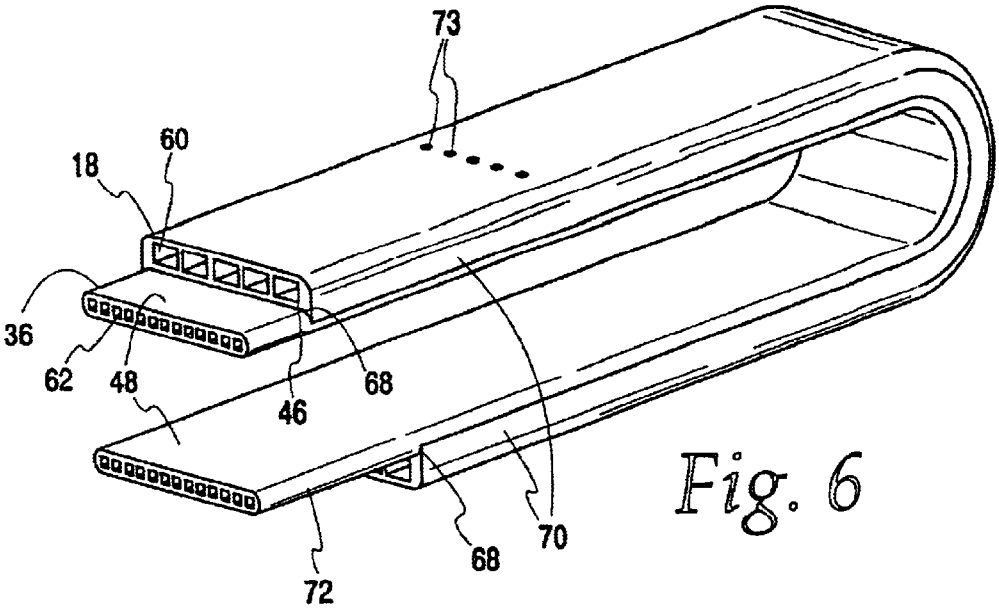
FIG. 6 depicts the close heat exchange relation between the flat tubes of an embodiment of the present invention.

FIG. 6 depicts the relationship between a low-pressure multi-port flat tube 18 and a high-pressure multi-port flat tube 36 used in the integrated unit 10 described herein. Multi-port flat tubes are preferred in high pressure transcritical cooling systems which often use carbon dioxide as a refrigerant, because they are able to withstand the higher pressures at which such systems operate while providing superior heat transfer performance. The low-pressure multi-port flat tube 18 and high-pressure multi-port flat tube 36 may be a single piece produced by co-extrusion or may be separate pieces that are closely aligned in conductive heat exchange relation as shown. The low-pressure flat tube 18 has a row of flow passages 60, however, the low-pressure tube may also be a single port low pressure tube. The high-pressure flat tube 36 has a row of internal flow passages 62, and preferably, the flow passages 60 of the low-pressure flat tube 18 are of a larger cross-sectional area than the flow passages 62 of high-pressure flat tube 36. The low-pressure flat tube 18 has a broad outside surface 46 that contacts a broad outside surface 48 of the high pressure flat tube 36. As an optional feature, the low pressure flat tube 18 has an extension 68 of a narrow side 70 that partially wraps around a narrow side 72 of the high pressure flat tube 36. The extension 68 may be included on the opposite narrow side 70 of the low pressure tube 36 to further assist in locating the tubes 18, 36 relative to each other. It should be appreciated that, as an alternative, similar extension may be located on the high pressure tube 36 to wrap around the narrow sides 70 of the low pressure flat tube 18 for the same purpose and effect. As another option holes 73 that open to one or more of the passages 60 may be provided in an upper region of the tube 18 to allow liquid refrigerant that may gather in the upper region of the chamber 17 to be metered into the tube 18 by the vapor refrigerant flow therein. Preferably, when holes 73 are present in the low-pressure mult-port flat tube 18, each flow passage 60 contains a hole 73.

As another option, one or more small holes (not shown) that open to the flow passages 60 may be provided at the bottom of the low pressure conduit 18 to allow oil that has been separated from the liquid refrigerant and gathered at the bottom of the chamber 17 to be drawn into the low pressure refrigerant stream exiting the integrated unit 10 via the flow passages 60. Further, a drain port 80 may be provided at the bottom of the chamber 17 so that separated oil can be reintroduced to the cooling system via a suitable conduit.

Figure 7:
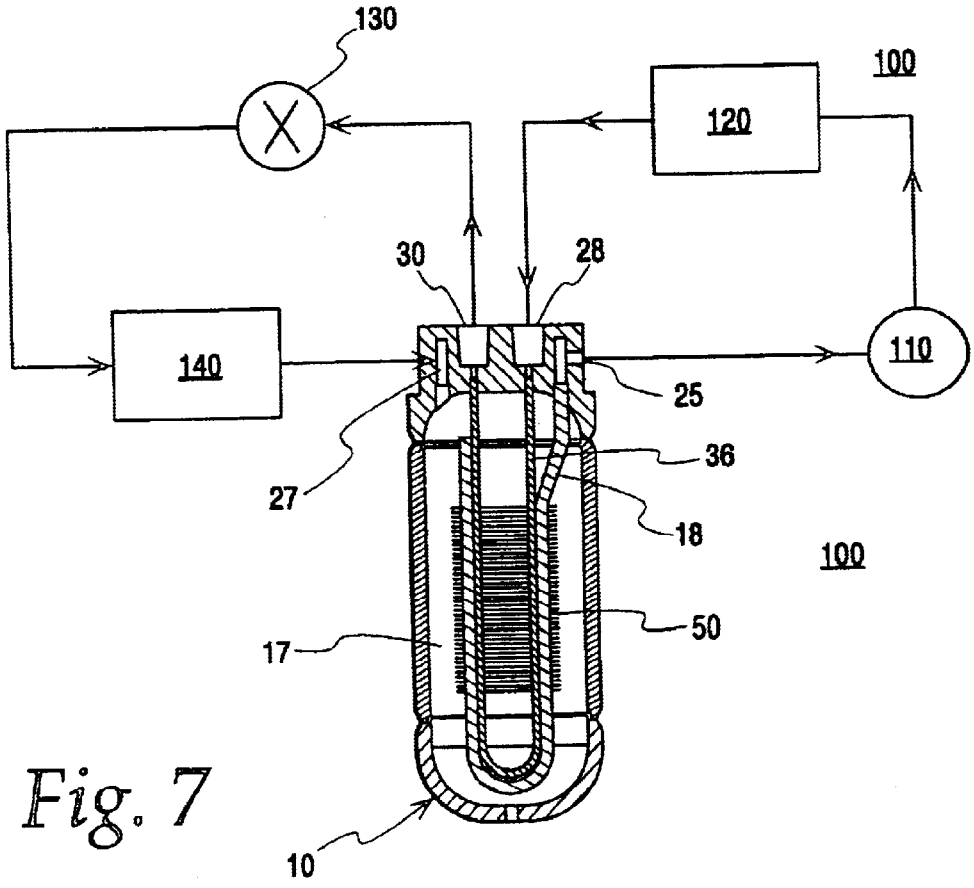
FIG. 7 is a schematic representation of a refrigeration system in which the integrated suction line heat exchanger and accumulator units of the present invention may be used.

FIG. 7 depicts an example of a typical refrigeration system 100 in which the integrated unit 10 may be used. The system 100 has a compressor 110 for compressing the refrigerant; a heat exchanger 120, that is typically a condenser or gas cooler, to reject heat from the refrigerant generated by the compressor 110, an expansion device 130 to expand the compressed refrigerant, and an evaporator 140 to transfer heat to the expanded refrigerant.

The integrated unit 10 serves the purpose of separating liquid phase refrigerant from the vapor phase refrigerant prior to the vapor phase refrigerant entering the compressor 110. Liquid refrigerant accumulates in the lower part of the chamber 17 of the refrigerant integrated unit 10. Heat is transferred to the low pressure refrigerant in the chamber 17 and the low-pressure conduit 18 from the high pressure refrigerant in the high-pressure conduit 36, thereby assisting in the vaporization of any liquid refrigerant within the unit 10 before the low pressure refrigerant exits the unit 10 via the low-pressure conduit 18. This reduces the possibility that slugs of liquid refrigerant will be passed to the compressor 110, which can damage the compressor 110. Futhermore, the above described heat transfer in the integrated unit 10 also cools the high pressure refrigerant in the high-pressure conduit 36 prior to the refrigerant entering the expansion devices 130, which can improve the overall performance of the cooling system.

The use of any and all examples, or exemplary language (e.g., "such as" or "for example") provided herein, is intended merely to better illuminate the invention and does not pose a limitation on the scope of the invention unless recited in a claim. While some potential advantages and objects have been expressly identified herein, it should be understood that some embodiments of the invention may not provide all, or any, of the expressly identified advantages and objects. Preferred embodiments of this invention are described herein, including the best mode known to the inventors for carrying out the invention. Of course, variations of those preferred embodiments will become apparent to those of ordinary skill in the art upon reading the foregoing description. For example, the housing 12 and caps 14 and 16 are a three piece, substantially cylindrical construction, but in some applications other constructions, such as two piece and/or non-cylindrical, may be desired. As another example, while plate fins 50 are shown, other types of fins may be desirable in certain applications. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An integrated unit in a refrigeration system having a refrigerant loop with a high pressure refrigerant flowing through a portion of the loop to reject heat from the system and a low pressure refrigerant flowing through another portion of the loop to absorb heat to the system, the unit comprising:

a housing having a collection reservoir for the refrigerant;

a low pressure flat tube extending into the collection reservoir to direct the low pressure refrigerant therethrough; and a high-pressure flat tube extending into the collection reservoir to direct the high pressure refrigerant therethrough;

wherein a broad side of the low pressure flat tube and a broad side of the high pressure flat tube are in conductive heat exchange relation to each other within the collection reservoir.

2. An integrated unit in a refrigeration system, the unit comprising:

a housing having a collection reservoir, a low pressure refrigerant inlet port, a low pressure refrigerant outlet port, a high pressure refrigerant inlet port and a high pressure refrigerant outlet port;

a low pressure conduit connected in the housing to the low pressure refrigerant outlet port to direct low pressure refrigerant from the collection reservoir to the low pressure refrigerant outlet port;

a high pressure conduit extending in the housing from the high pressure refrigerant inlet port to the high pressure refrigerant outlet port; and a plurality of heat exchange fins extending from the high-pressure conduit and the low-pressure conduit in the collection reservoir, each fin is in conductive heat exchange relation with both the high-pressure conduit and the low-pressure conduit.

3. The integrated unit of claim 2 wherein the low pressure conduit and the high pressure conduit are flat tubes.

4. The integrated unit of claim 3 wherein the low-pressure flat tube and the high pressure flat tube are in conductive heat exchange relation to each other.

5. The integrated unit of claim 3 wherein the low pressure flat tube and the high pressure flat tube have longitudinal axes extending parallel to each other.

6. The integrated unit of claim 2 wherein the plurality of heat exchange fins extend transversely from both the high-pressure conduit and low-pressure conduit in the collection reservoir.

7. The integrated unit of claim 2 further comprising at least one slot in each fin to receive both tubes.

8. The integrated unit of claim 7 wherein each slot is open to an edge of the fin to allow assembly of the fins onto the tubes.

9. An integrated unit in a refrigeration system, the unit comprising:

a housing having a collection reservoir, a low pressure refrigerant inlet port, a low pressure refrigerant outlet port, a high pressure refrigerant inlet port and a high pressure refrigerant outlet port;

a low pressure conduit connected in the housing to the low pressure refrigerant outlet port to direct low pressure refrigerant from the collection reservoir to the low pressure refrigerant outlet port;

a high pressure conduit extending in the housing from the high pressure refrigerant inlet port to the high pressure refrigerant outlet port; and at least one of heat exchange fin extending between a first leg of the high-pressure conduit and a second leg of the high-pressure conduit in the collection reservoir and being in conductive heat exchange relation with the high-pressure conduit.

10. The integrated unit of claim 9 wherein the at least one fin is a serpentine fin.

11. An integrated unit in a refrigeration system, the unit comprising:

a housing having a collection reservoir, a low pressure refrigerant inlet port, a low pressure refrigerant outlet port, a high pressure refrigerant inlet port and a high pressure refrigerant outlet port;

a low pressure conduit with an outside surface and a longitudinal axis, the low pressure conduit extending in the collection reservoir and connected to the low pressure refrigerant outlet port to direct low pressure refrigerant from the collection reservoir to the low pressure refrigerant outlet port; and a high pressure conduit with an outside surface and a longitudinal axis, the high pressure conduit extending in the collection reservoir from the high pressure refrigerant inlet port to the high pressure refrigerant outlet port;

wherein in the collection reservoir the longitudinal axes extend parallel to one another over a length and the outside surfaces are in conductive heat exchange relation.

12. The integrated unit of claim 11 wherein the outside surfaces are in direct contact with one another.

13. The integrated unit of claim 11 further comprising a plurality of heat exchange fins extending transversely from the high-pressure conduit and from the low-pressure conduit, each fin in conductive heat exchange relation with both the high-pressure conduit and the low-pressure conduit.

14. A refrigeration system comprising:

a compressor to compress a refrigerant;

a heat exchanger to reject heat from the compressed refrigerant;

an expansion device to expand the compressed refrigerant;

an evaporator to transfer heat to the refrigerant; and an integrated suction line heat exchanger and accumulator, the integrated suction line heat exchanger and accumulator including a collection reservoir, a low pressure flat tube extending into the collection reservoir to direct the expanded refrigerant therethrough, and a high pressure flat tube extending into the collection reservoir to direct the compressed refrigerant therethrough;

wherein a broad side of the low pressure flat tube and a broad side of the high pressure flat tube are in conductive heat exchange relation within the housing.

15. A refrigeration system comprising:

a compressor to compress a refrigerant;

a heat exchanger to reject heat from the compressed refrigerant;

an expansion device to expand the compressed refrigerant;

an evaporator to transfer heat to the refrigerant;

an integrated suction line heat exchanger and accumulator, the integrated suction line heat exchanger and accumulator having a collection reservoir; a low pressure refrigerant inlet port, a low pressure refrigerant outlet port, a high pressure refrigerant inlet port and a high pressure refrigerant outlet port, a low pressure conduit connected in the housing to the low pressure refrigerant outlet port to direct the expanded refrigerant from the collection reservoir to the low pressure refrigerant outlet port, a high pressure conduit extending in the housing from the high pressure refrigerant inlet port to the high pressure refrigerant outlet port; and a plurality of heat exchange fins extending from the high-pressure conduit and the low-pressure conduit in the collection reservoir, each fin in conductive heat exchange relation with both the high pressure line and the low-pressure line.

16. A refrigeration system comprising:

a compressor to compress a refrigerant;

a heat exchanger to reject heat from the compressed refrigerant;

an expansion device to expand the compressed refrigerant;

an evaporator to transfer heat to the refrigerant; and an integrated suction line heat exchanger and accumulator, the integrated suction line heat exchanger and accumulator having a collection reservoir; a low pressure refrigerant inlet port, a low pressure refrigerant outlet port, a high pressure refrigerant inlet port and a high pressure refrigerant outlet port, a low pressure conduit with an outside surface and a longitudinal axis and connected in the collection reservoir to the low pressure refrigerant outlet port to direct the expanded refrigerant from the collection reservoir to the low pressure refrigerant outlet port, and a high pressure conduit with an outside surface and a longitudinal axis, the high pressure conduit extends in the collection reservoir from the high pressure refrigerant inlet port to the high pressure refrigerant outlet port;

wherein in the collection reservoir the longitudinal axes extend parallel to one another over a length and the outside surfaces are in conductive heat exchange relation.

* * * * *